US010465424B2

(12) United States Patent
Ishiguro et al.

(10) Patent No.: US 10,465,424 B2
(45) Date of Patent: Nov. 5, 2019

(54) VEHICLE DOOR LATCH DEVICE

(71) Applicant: GECOM CORPORATION, Greensburg, IN (US)

(72) Inventors: Katsuyuki Ishiguro, Novi, MI (US); Bryan Farris, Novi, MI (US)

(73) Assignee: GECOM CORPORATION, Greensburg, IN (US)

( * ) Notice: Subject to any disclaimer, the term of this patent is extended or adjusted under 35 U.S.C. 154(b) by 319 days.

(21) Appl. No.: 15/416,232

(22) Filed: Jan. 26, 2017

(65) Prior Publication Data

US 2018/0209180 A1 Jul. 26, 2018

(51) Int. Cl.
*E05B 77/04* (2014.01)

(52) U.S. Cl.
CPC ..... *E05B 77/04* (2013.01)

(58) Field of Classification Search
CPC ..... E05B 77/02; E05B 77/04; E05B 77/06; E05B 77/54; E05B 85/243; E05B 85/26; Y10T 292/1047; Y10T 292/1082; Y10T 292/0908; Y10T 292/1048; Y10T 292/1046; Y10S 292/22; Y10S 292/23; Y10S 292/65
See application file for complete search history.

(56) References Cited

U.S. PATENT DOCUMENTS 9,109,380 B2 * 8/2015 Mittelbach ..... E05B 77/06
9,366,063 B2 * 6/2016 Rosales ..... E05B 77/06
9,593,511 B2 * 3/2017 Hunt ..... E05B 77/06
9,879,450 B2 * 1/2018 Wahmann ..... E05B 77/06
2014/0203575 A1 7/2014 Brickner et al.
2014/0284941 A1 * 9/2014 Wittelsbuerger ..... E05B 77/06 292/92
2014/0284942 A1 * 9/2014 Wittelsbuerger ..... E05B 77/06 292/92
2014/0284943 A1 * 9/2014 Wittelsbuerger ..... E05B 77/06 292/92
2015/0159408 A1 * 6/2015 Hunt ..... E05B 77/06 292/341.17
2015/0315824 A1 * 11/2015 Gotzen ..... E05B 77/06 292/200

(Continued)

FOREIGN PATENT DOCUMENTS

JP 2016-505098 A 11/2016
WO 2014111818 A2 7/2014

*Primary Examiner* — Alyson M Merlino
(74) *Attorney, Agent, or Firm* — Davis & Bujold PLLC; Michael J. Bujold

(57) ABSTRACT

A vehicle door latch device comprises a latch that can engage with a striker; a ratchet that engages with the latch to hold a door closed; a stationary stopper; a first lever pivotally mounted on a first shaft to rotate from an initial position in a releasing direction; a first spring that biases the first lever toward the initial position, a second lever supported to the first lever on a second shaft and rotating between an initial position where the second lever cannot contact the stationary stopper and a blocking position where the second lever can contact the stationary stopper and prevents the first lever from rotating in the releasing direction; and a second spring that biases the second lever toward the initial position with a force greater than a biasing force of the first spring.

3 Claims, 10 Drawing Sheets

(56) References Cited

U.S. PATENT DOCUMENTS

| | | | | |
|---|---|---|---|---|
| 2016/0010363 | A1* | 1/2016 | Wahmann | E05B 77/04 292/92 |
| 2016/0160540 | A1* | 6/2016 | Bejune | E05B 77/06 292/196 |
| 2018/0066458 | A1* | 3/2018 | Ishiguro | E05B 77/06 |
| 2018/0216370 | A1* | 8/2018 | Ishiguro | E05B 77/06 |
| 2018/0230715 | A1* | 8/2018 | Ishiguro | E05B 77/06 |
| 2018/0313118 | A1* | 11/2018 | Hattori | E05B 77/06 |

* cited by examiner

VEHICLE DOOR LATCH DEVICE

BACKGROUND OF THE INVENTION

The present invention relates to a vehicle door latch device, and particularly to a vehicle door latch device that prevents a door from opening if a door panel is deformed by a crash.

When a door panel is deformed by a crash, a conventional vehicle door latch device for preventing a door from opening is described in JP2016-505098A.

The vehicle door latch device in JP2016-505098A comprises a rotary catch that can engage with a striker; a pawl that can engage with the rotary catch; an opening lever for releasing the pawl; a rotatable inertial lever; a preventing lever that is rotatably supported to the inertial lever; and a safety lever that is contacted with a contour portion of the inertial lever by a force to apply resistance against a rotation of the inertial lever. When a door handle is operated manually, the preventing lever rotates together with the inertial lever around an axis of the inertial lever. When the opening lever rotates at an excessive high speed owing to a crash, the present lever rotates to a position where it can contact the safety lever, thereby preventing the ratchet from rotating and preventing the door from opening.

However, in the vehicle door latch device in JP2016-505098A, the safety lever is contacted with the contour portion of the inertial lever by a force to apply resistance against the rotation of the inertial lever. Thus, dust adhered into a gap between the contour portion of the inertial lever and the safety lever and a freeze of rain water cause excessive resistance that acts on the inertial lever. Even if the door handle is operated manually, the preventing lever rotates to a position for preventing the inertial lever from rotating thereby causing a problem that the door cannot be opened.

SUMMARY OF THE INVENTION

In view of the disadvantages, it is an object of the present invention to provide a vehicle door latch device in which a door can manually be opened securely, wherein the door is prevented securely from opening if a door panel is deformed by a crash.

BRIEF DESCRIPTION OF THE DRAWINGS

FIG. 6(*b*) is an enlarged view of an encircled area b shown in FIG. 6(*a*).

FIG. 7(*b*) is an enlarged view of an encircled area b shown in FIG. 7(*a*).

FIG. 8(*b*) is an enlarged view of an encircled area b shown in FIG. 8*a*.

FIG. 9(*b*) is an enlarged view of an encircled are b shown in FIG. 9(*a*).

FIG. 10(*b*) is an enlarged view of an encircled area b shown in FIG. 10(*a*).

DETAILED DESCRIPTION OF PREFERRED EMBODIMENT

One embodiment of the present invention will be described with the drawings.

Figure 1:
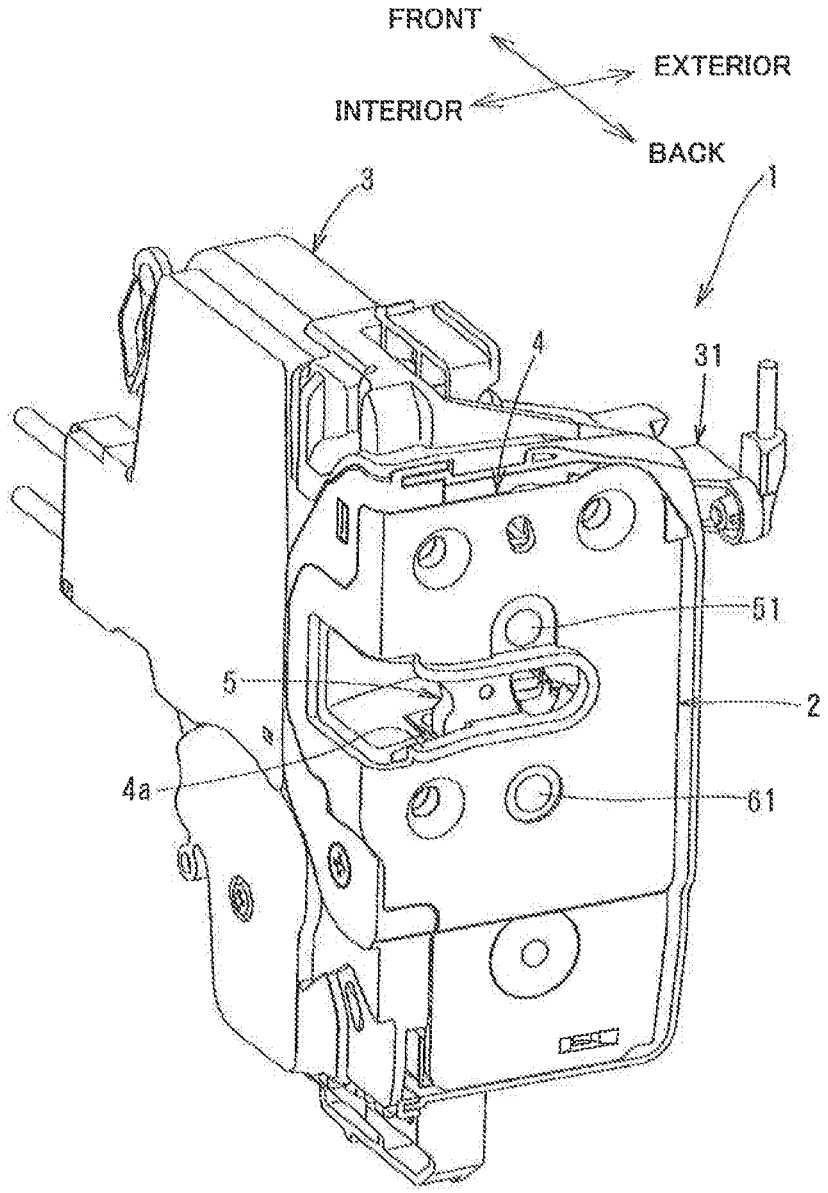
FIG. 1 is a perspective view of a vehicle door latch device according to the present invention.
Figure 2:
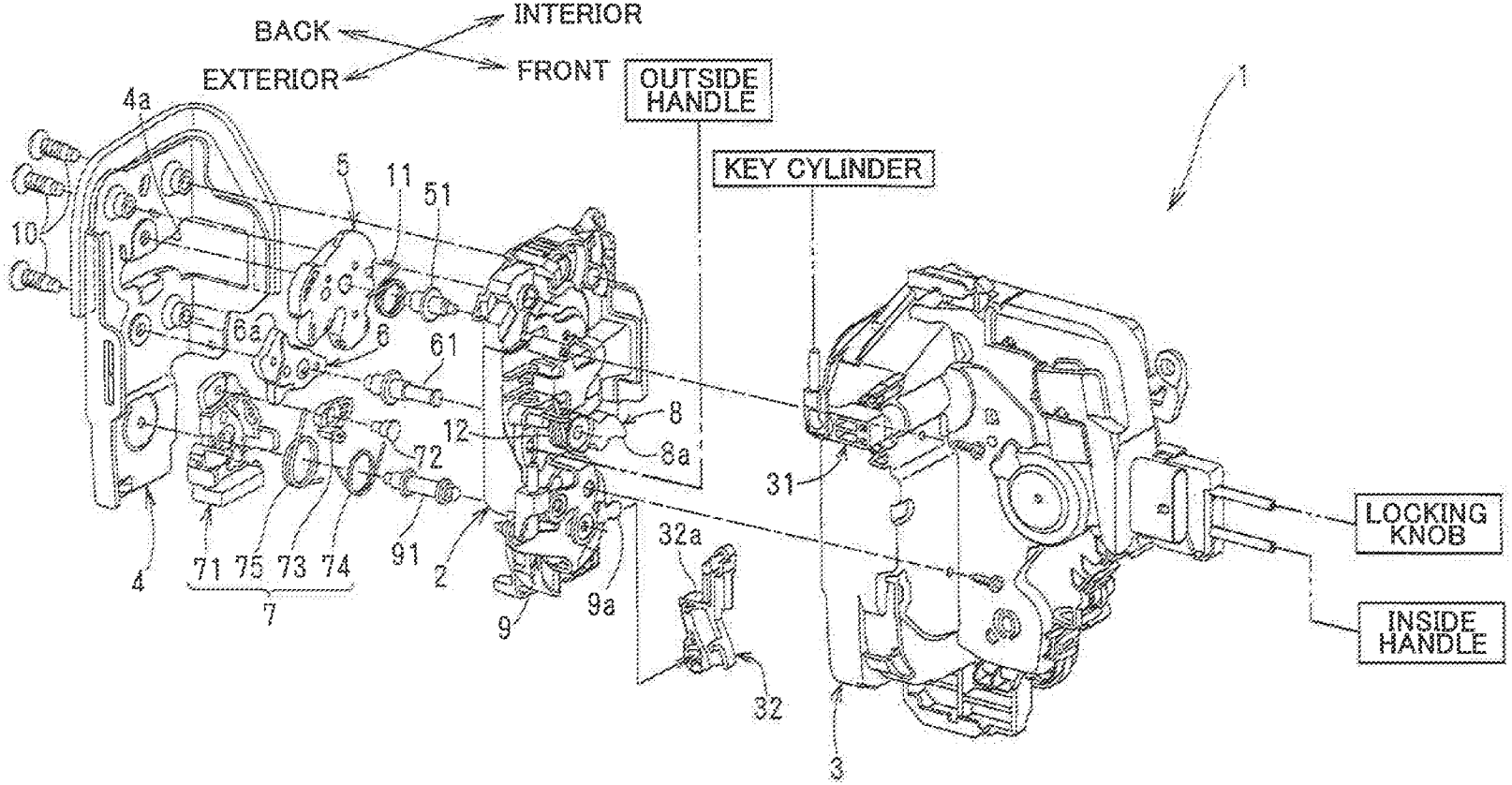
FIG. 2 is an exploded perspective view thereof.
Figure 3:
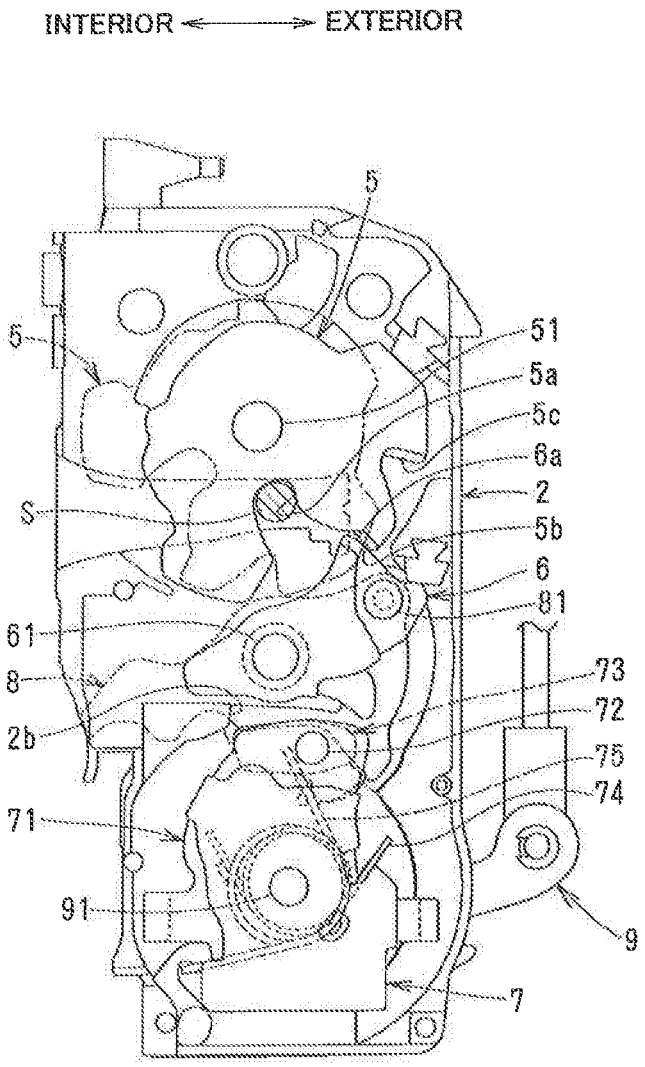
FIG. 3 is a front elevational view of an engagement unit of the vehicle door latch device.

FIG. 1 is a perspective view of a vehicle door latch device 1; FIG. 2 is an exploded perspective view of the vehicle door latch device 1; and FIG. 3 is a front elevational view of an engagement unit. A direction in the following description is defined at the vehicle door latch device 1 attached in a vehicle door.

The door latch device 1 in FIGS. 1 and 2 comprises an engagement unit that comprises an engagement mechanism housing 2 that includes an engagement mechanism that is disposed at the rear end in a front door pivotally attached on a vertical hinge shaft at the side of a vehicle body and engages a striker S at a vehicle body to hold the door closed; and an operation unit that includes an operating mechanism housing 3 that includes a locking mechanism and other elements later described.

On the exterior side of the door, there are provided a manually-locking/unlocking key cylinder (not shown) and an outside handle (not shown) that is door opening means for opening the door from the exterior of the vehicle, and on the interior side of the door, there are provided a manually locking/unlocking knob (not shown) and an inside handle (not shown) that is door opening means for opening the door from the interior of the vehicle.

The internal structure of the operating unit is known and does not directly relate to the present invention. So it is not shown in the drawings, and its description is limited within what can be understood by those skilled in the art.

The operating mechanism housing 3 of the operating unit is fixed to the engagement mechanism housing 2 to cover the front surface of the engagement mechanism housing 2. A key lever 31 connected to the key cylinder is pivotally attached on the outer upper part of the operating mechanism housing 3, and comprises in a internal space an electric motor (not shown) that can be driven through remote locking/unlocking control with a portable device which a driver carries, an inside lever (not shown) connected to the inside handle, and the locking mechanism (not shown) operated with the key lever 31 and the locking knob.

The locking mechanism comprises a locking lever (not shown) connected to the key lever 31 and the locking knob; and a lift lever connected to the locking lever and an outside lever (later described), and is driven with the key cylinder or the locking knob manually or through remote control by the portable device to rotate from a locked state to an unlocked state and vice versa.

The locking mechanism in this embodiment can be open the door by the inside handle even when the door is locked, which is called "one-motion manner". Thus, the door can be opened by the outside handle or the inside handle in the unlocked state. In the locked state, the door can be opened by the inside handle, but cannot be opened by the outside handle. However, the locking mechanism is not limited to this embodiment, and may be constructed such that the door cannot be opened with the outside handle or the inside handle.

In FIG. 2, the engagement unit comprises the synthetic-resin engagement-mechanism housing 2 closed at the back by a metal cover member 4. The engagement-mechanism housing 2 is a base member in this invention. In an inner space formed by the engagement-mechanism housing 2 and the cover member 4, the base member comprises an engagement mechanism that includes a latch 5 that can engage with a striker S and a ratchet 6 that can engage with the latch 5; and preventing means 7 that prevents the ratchet 6 from releasing or disengaging from the latch 5 owing to deformation of the door panel caused by a crash.

On a front face of the engagement-mechanism housing 2, there are disposed an opening lever 8 rotating with the latch 5, and an outside lever 9 connected to an outside handle. The engagement-mechanism housing 2 is fixed to an inner surface of the door with a plurality of bolts so that the cover member 4 faces the inner surface of the door.

Figure 4:
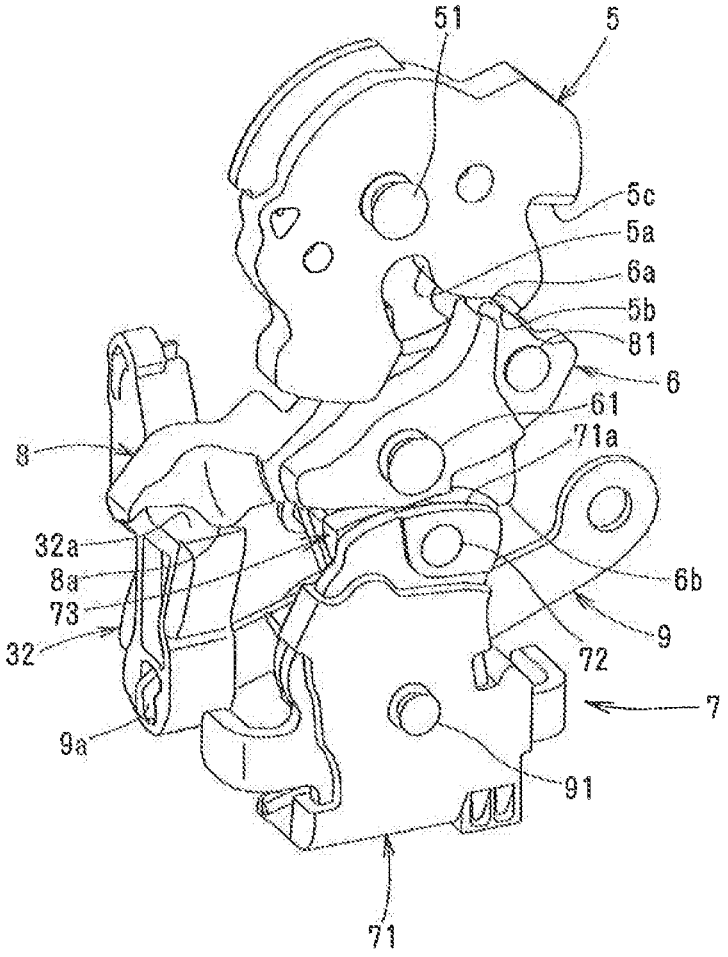
FIG. 4 is a perspective view of the engagement unit and other main parts.
Figure 5:
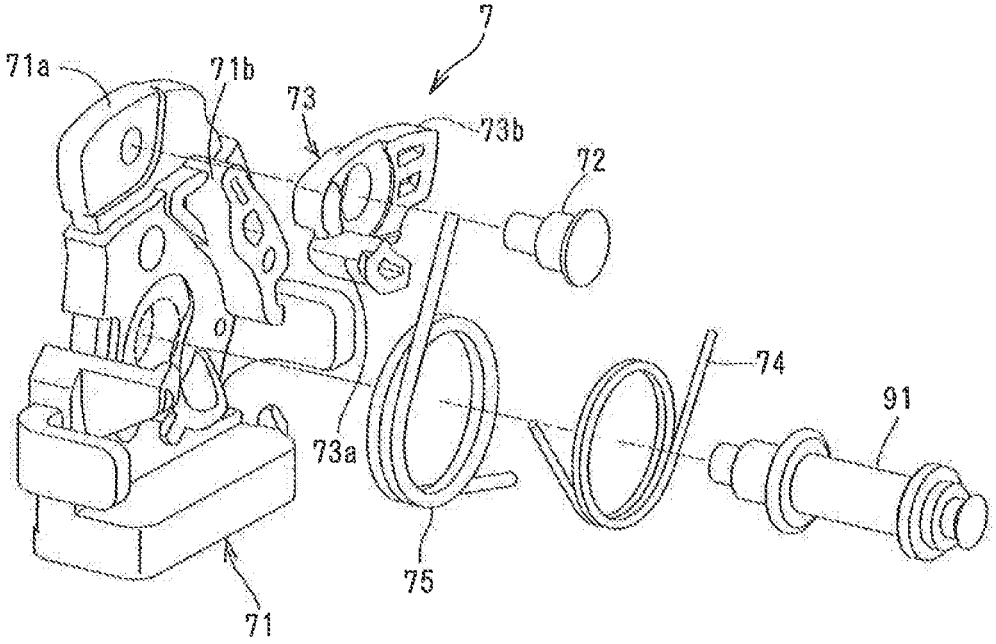
FIG. 5 is an exploded perspective view of preventing means.
Figure 6A:
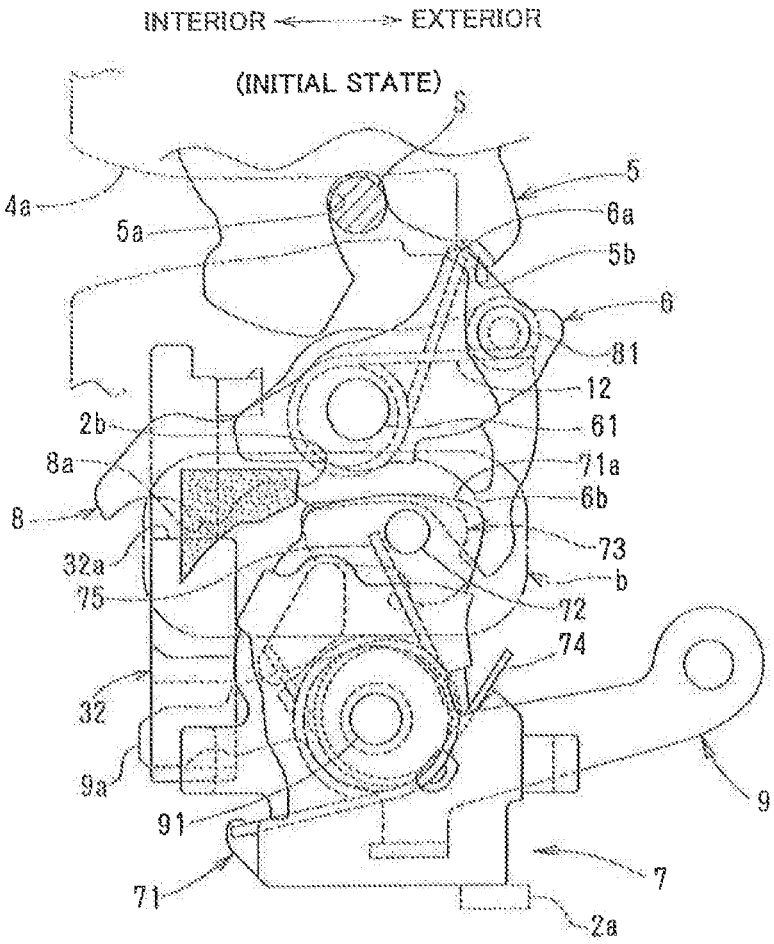
FIG. 6(*a*) is a front elevational view of a main part of the engagement unit in a full-latch state when the preventing means is in an initial state.
Figure 6B:
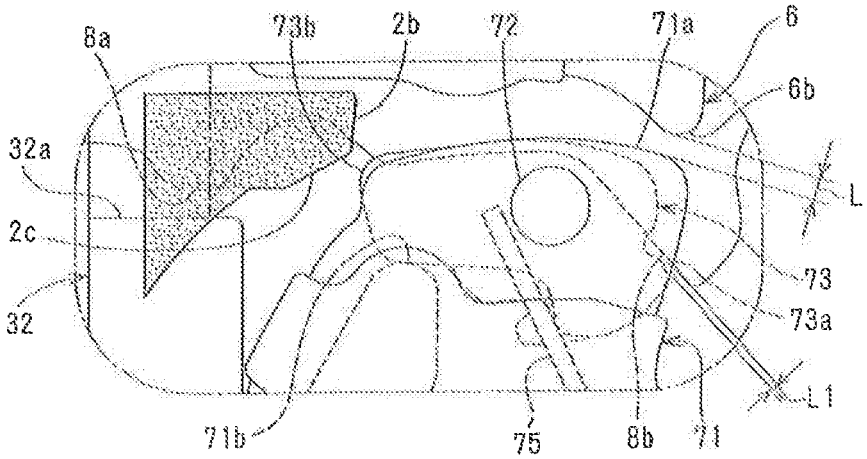
Figure 7A:
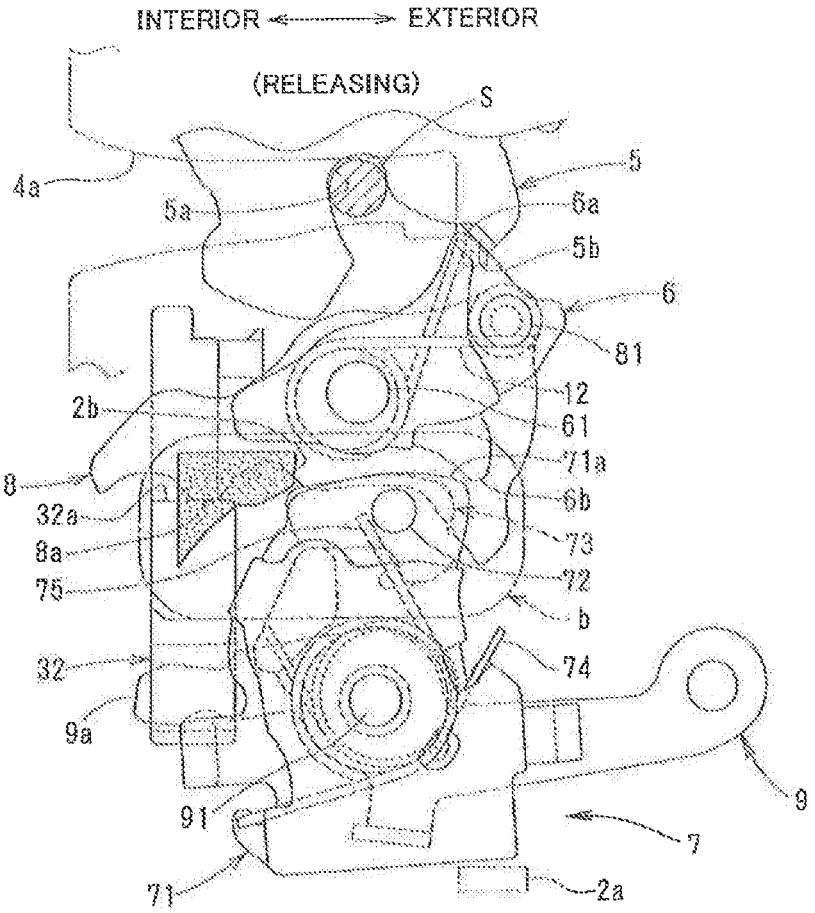
FIG. 7(*a*) is a front elevational view of the main part of the engagement unit when a ratchet and an opening lever are released manually to open the door.
Figure 7B:
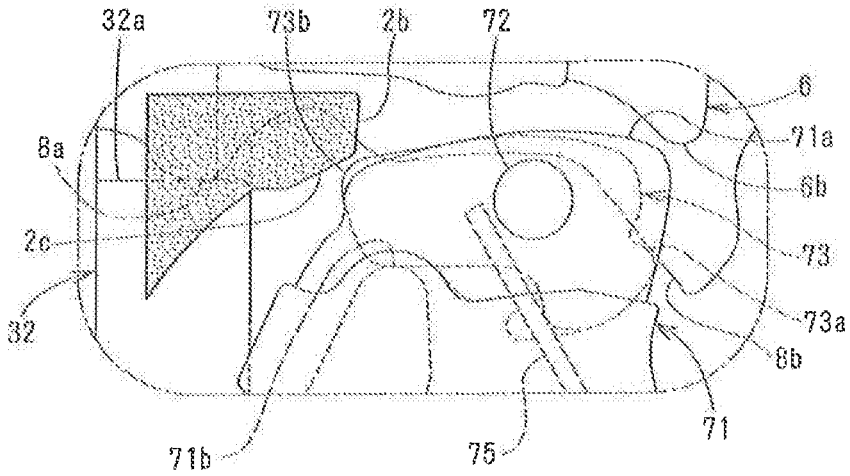
Figure 8A:
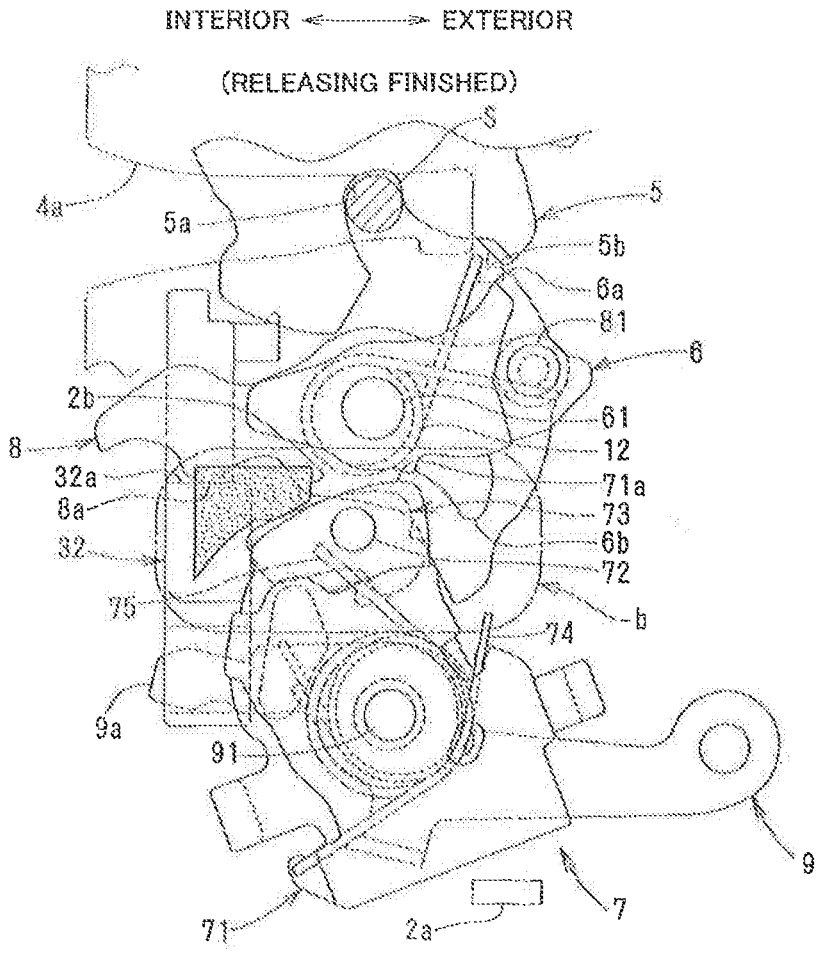
FIG. 8(*a*) is a front elevational view of the main part of the engagement unit when the ratchet and the opening lever are finished in releasing.
Figure 8B:
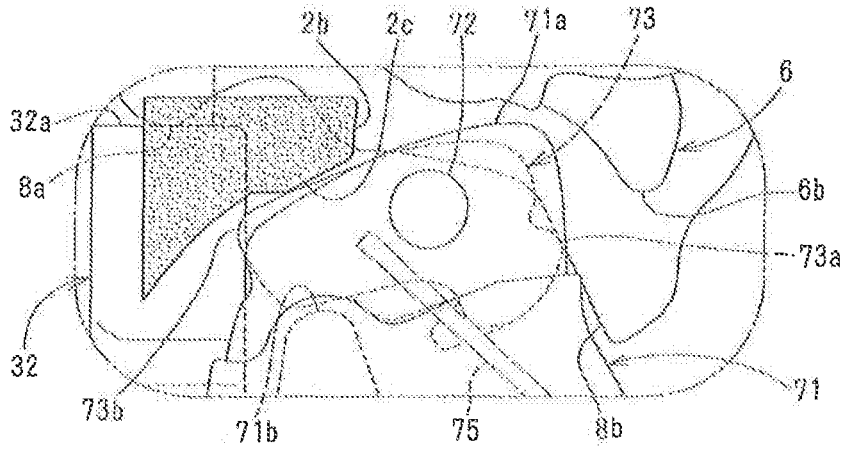
Figure 9A:
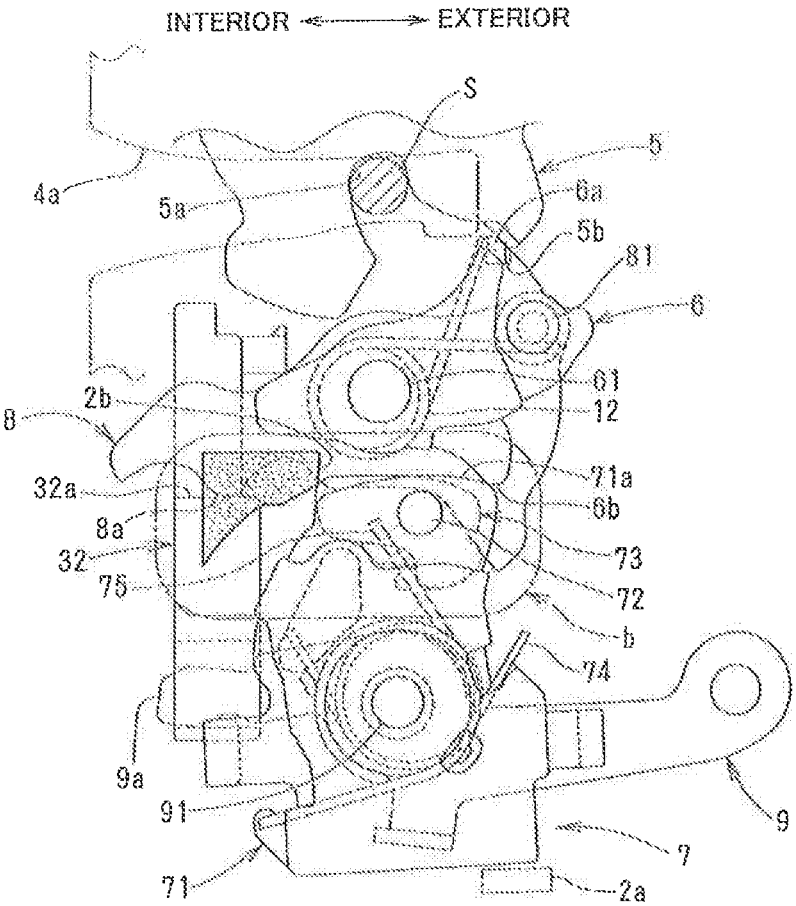
FIG. 9(*a*) is a front elevational view of the main part of the engagement unit when the ratchet and the opening lever are released at a high speed.
Figure 9B:
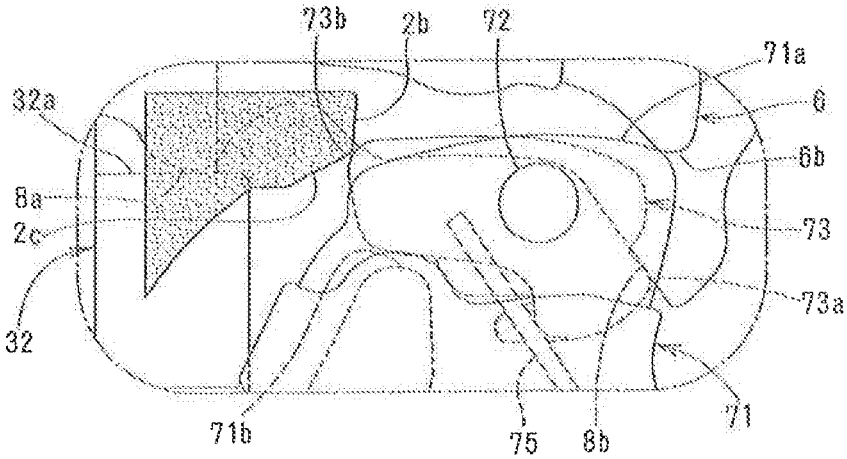
Figure 10A:
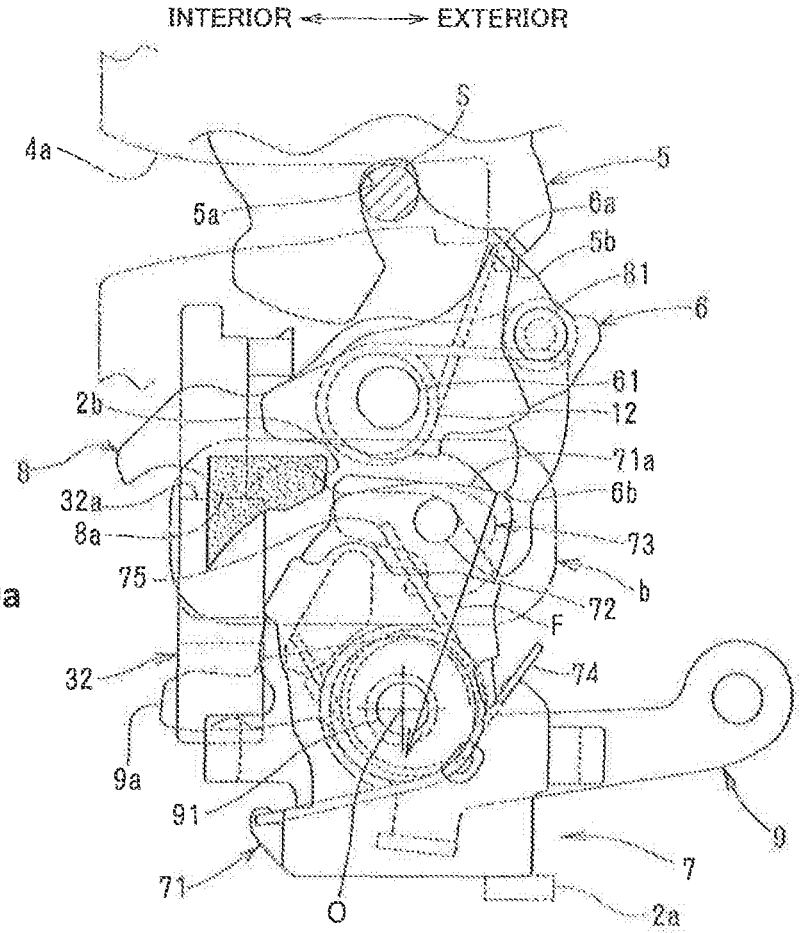
FIG. 10(*a*) is a front elevational view of the main part of the engagement unit when the ratchet and the opening lever are released at a super high speed.
Figure 10B:
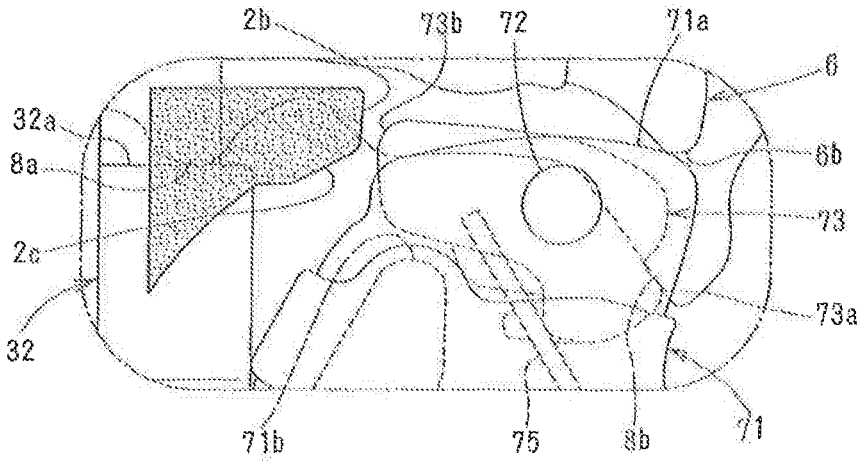

FIG. 4 is a perspective view of the engagement unit and other main parts; FIG. 5 is an exploded perspective view of the preventing means 7; FIG. 6 is a front elevational view of a main part of the engagement unit when the preventing means 7 is in an initial state; FIG. 6(*b*) is an enlarged view of a part "b" in FIG. 6(*a*); FIG. 7(*a*) is a front elevational view of the main part of the engagement unit when the ratchet 6 and the opening lever 8 are released by opening the door manually; FIG. 7(*b*) is an enlarged view of a part "b" in FIG. 7(*a*); FIG. 8(*a*) is a front elevational view of the main part of the engagement unit when the ratchet 6 and the opening lever 8 finish releasing; FIG. 8(*b*) is an enlarged view of a part "b" in FIG. 8(*a*); FIG. 9(*a*) is a front elevational view of the main part of the engagement unit in which the ratchet 6 and the opening lever 8 are released at a high speed; FIG. 9(*b*) is an enlarged view of a part "b" in FIG. 9(*a*); FIG. 10(*a*) is a front elevational view of the main part of the engagement unit when the ratchet 6 and the opening lever 8 are released at a super high speed; and FIG. 10(*b*) is an enlarged view of a part "b" in FIG. 10(*a*).

In FIG. 3, the latch 5 of the engagement mechanism is pivotally mounted in the engagement-mechanism housing 3 on a latch shaft 51 which extends along a length of the vehicle; and has an engagement groove 5*a* which can engage with the striker S which can come in a striker-coming-in groove 4*a* in FIGS. 1 and 2, a full-latch engagement portion 5*b* and a half-latch engagement portion 5*c* with which the pawl 6*a* of the ratchet 6 can engage from below. With a door-closing motion, the latch 5 rotates counterclockwise at a certain angle against a biasing force of a spring 11 which acts on the latch 5 in FIG. 2 from an open position shown in a two-dash line in FIG. 3 to a full-latch position shown in a solid line in FIG. 3 in which the striker S fully engages with the engagement groove 5*a* via a half-latch position in which the striker S slightly engages with the engagement groove 5*a*, and rotates reversely with a door-opening motion. In order to show an internal structure of the engagement unit clearly, FIG. 3 appears without the cover member 4.

The ratchet 6 is pivotally mounted in the engagement-mechanism housing 2 on a ratchet shaft 61 which extends along the length of the vehicle and is biased in an engaging direction or counterclockwise in FIG. 3 by a spring 12 which acts on the opening lever 8. By engaging the pawl 6*a* with the half-latch engagement portion 5*c*, the ratchet 6 holds the latch 5 in a half-latch position in which the door is not closed completely, and by engaging the pawl 6*a* with the full-latch engagement portion 5*b*, the ratchet 6 holds the latch 5 in a full-latch position in which the door is completely closed. The pawl 6*a* is released from an engagement position in FIGS. 3 and 6 in which the pawl 6*a* engages with the full-latch engagement portion 5*b* or the half-latch engagement portion 5*c* completely. The pawl 6*a* moves against the spring 12 in a releasing direction or clockwise and disengages from each of the engagement portions 5*b*, 5*c* to enable the door to open.

The opening lever 8 is pivotally mounted on the ratchet shaft 61 on a front surface of the engagement-mechanism housing 2 and is connected to the ratchet 6 with a connecting pin 81 to rotate with the ratchet 6.

In this embodiment, the ratchet 6 is separate from the opening lever 8. The ratchet 6 that always rotates together with the opening lever 8 may be formed integrally with the opening lever 8.

The outside lever 9 is pivotally mounted on a lower part of a front surface of the engagement-mechanism housing 2 on a shaft 91 which extends along a length of the vehicle and is connected to the outside handle. Thus, the outside lever 9 is rotated at a certain angle around the shaft 91 by the outside handle in a releasing direction or clockwise in FIGS. 3 and 6, so that a lift lever 32 coupled to an end 9*a* of the outside lever 9 rotates upward.

In an unlocking state of the locking mechanism, the outside handle is operated to open the door, and the lift lever 32 is moved via the outside lever 9. A releasing portion 32*a* of the lift lever 32 comes in contact with a released portion 8*a* of the opening lever 8 from below, and the opening lever 8 and the ratchet 6 rotate. The inside handle is operated to open the door, and the inside lever rotates. A part of the inside lever comes in contact with part close to the released portion 8*a* of the opening lever 8, so that the opening lever 8 and the ratchet 6 rotate, and the door can be opened.

In a locked state of the locking mechanism, when the outside handle is operated to open the door, even if the lift lever 32 is rotated by an opening action of the outside handle, the releasing portion 32*a* swings and misses with respect to the released portion 8*a*, so that the door cannot be opened. When the inside handle is operated to open the door, the ratchet 6 and the opening lever 8 are rotated as well as in the locking state, so that the door can be opened.

The preventing means 7 comprises a first lever 71 pivotally mounted on the first shaft 91 on which the outside lever 9 is also pivotally mounted under the ratchet 6 to the engagement-mechanism housing 2 corresponding to the base member of the present invention; a synthetic-resin second lever 73 pivotally mounted to an upper part of the first lever 71 on a second shaft 72 extending along the length of the vehicle; a first spring 74 that acts on the first lever 71; and a second spring 75 that acts on the second lever 73.

The first spring 74 engages at one end to the engagement-mechanism housing 2, and at the other end to the first lever 71 respectively and applies a clockwise biasing force to the first lever 71 around the first shaft 91 in FIGS. 3 and 6.

The second spring 75 engages at one end to the first lever 71 and at the other end to the second lever 73 respectively, and applies a counterclockwise biasing force to the second lever 73 around the second shaft 72 in FIGS. 3 and 6. The biasing force of the second spring 75 acting on the second lever 73 is set to be greater than the biasing force of the first spring 74 acting on the first lever 71.

The first lever 71 is made of metal covered with synthetic resin and is held in an initial position in which the lower end comes in contact with a first-lever stopper 2*a* of the engagement-mechanism housing 2 clockwise by the biasing force of the first spring 74 in FIG. 6(*a*) in an initial state.

In a sub-assembly state in which the second lever 73 and the second spring 75 are connected, the first lever 71 is formed such that the center of gravity is positioned at the center of rotation or an axis of the first shaft 91. Thus, even if an inertial force or acceleration acts from any directions at a crash, the first lever 71 in the sub-assembly state is held in the initial position without rotation.

When the first lever 1 is held in the initial position in FIGS. 6(*a*) and (*b*), there is formed a gap L between the arc-shaped preventing portion 71*a* at the upper edge and a claw-like contact portion 6*b* at the lower end of the ratchet 6 opposite the preventing portion 71*a* in FIG. 6(*b*). The arc of the preventing portion 71*a* is of a circle around the center spaced rightward about 2 mm from the shaft.

The gap L is set to be smaller than a distance corresponding to an engagement allowance of the pawl 6*a* of the ratchet 6 and the full-latch engagement portion or the half-latch engagement portion 5*c* of the latch 5.

In a state where the contact portion 6*b* of the ratchet 6 is in contact with the preventing portion 71*a* of the first lever 71, a line F of action on the preventing portion 71*a* deviates rightward of the center O of rotation of the first lever 71. Thus, when the contact portion 6*b* of the ratchet 6 comes in contact with the preventing portion 71*a* of the first lever 71, a force opposite a releasing direction or counterclockwise in FIG. 10 acts on the first lever 71 from the initial position to prevent the ratchet 6 from further acting in the releasing direction, so that the pawl 6*a* of the ratchet 6 does not disengage from the full-latch engagement portion 5*b* of the latch 5.

The second lever 73 is pivotally mounted on the second shaft 72 above the first lever 71 to rotate at a certain angle, and in the initial state, is held by the second spring 75 in the initial state where the left lower end near the interior of the vehicle is in contact with the upper end of the stopper 71*b* on the back of the first lever 71. Owing to deformation of the door panel caused by a crash, when a force for rotating the outside lever 9 in a releasing direction acts, a claw-like contact portion 8*b* of the opening lever 9 comes in contact with a contacted portion 73*a* at the right of the second lever 73 from the right, and the second lever 73 rotates against the second spring 75 around the second shaft 72 clockwise at a certain angle to a blocking position in FIGS. 9 and 10.

In a state where the second lever 73 is held in the initial position, in order to allow the first lever 71 to rotate in a releasing direction, the second lever 73 is held in a state in which the end 73*a* does not come in contact with a stationary stopper 2*b* of the engagement-mechanism housing 2 counterclockwise, a gap L1 smaller than the gap L is formed between the contacted portion 73*a* of the second lever 73 and the contact portion 8*b* of the opening lever 8 in FIG. 6(*b*). The stationary stopper 2*b* is formed integrally with the engagement-mechanism housing 2 above the first lever 71.

When the second lever 73 is at the blocking position, in order to prevent the first lever 71 from rotating counterclockwise in a releasing direction, the end 73*b* projects greatly upward from the upper edge of the first lever 71 to enable the second lever 73 to contact the stationary stopper 2*b* of the engagement-mechanism housing 2 counterclockwise.

Then, the engagement unit will be described as to function.

<When the door is closed>

In FIG. 6(*a*)(*b*), when the door is closed, the latch 5 is in a full-latch position where the pawl 6*a* of the ratchet 6 engages with the full-latch engagement portion 5*b* of the latch 5. The preventing means 7 is in the initial state in which the first lever 71 is held in the initial position in which the first lever 71 is contacted with the first stopper 2*a* of the engagement-mechanism housing 2 by the first spring 74. The second lever 73 is held in the initial position where the second lever 73 is contacted with the stopper 71*b* of the first lever 71 by the second spring 75.

When the first lever 71 is in the initial position, the gap L is formed between the preventing portion 71*a* of the first lever 71 and the edge of the contact portion 6*b* of the ratchet 6. The gap L1 smaller than the gap L is formed between the contact portion 8*b* of the opening lever 8 and the contacted portion 73*a* of the second lever 73. The gap L1 may be substantially zero.

<The outside handle or the inside handle is manually operated to open the door>

When the outside handle is manually operated to open the door in FIG. 6(*a*)(*b*), the lift lever 32 is rotated by the outside lever 9, and the releasing portion 32*a* of the lift lever 32 comes in contact with the released portion 8*a* of the opening lever 8 from below. The ratchet 6 and the opening lever 8 are released. When the inside handle is manually operated to open the door, the ratchet 6 and the opening lever 8 are released with rotation of the inside lever.

On releasing the ratchet 6 and the opening lever 8, at the initial motion in FIG. 7(*a*)(*b*), the contact portion 8*b* of the opening lever 8*b* comes in contact with the contacted portion 73*a* of the second lever 73, and the releasing motion of the opening lever 8 is transmitted to the first lever 71 via the second lever 73. Thus, when the outside handle or the inside handle is manually operated to open the door, in FIG. 8(*a*)(*b*), with the releasing motion of the ratchet 6, the first lever 71 rotates around the first shaft 91 against the first spring 74, and the second lever 73 revolves around the first shaft 91 while it is still in the first initial position. The pawl 6*a* of the ratchet 6 disengages from the full-latch engagement portion 5*b* of the latch 6, so that the door can be opened.

When the outside handle or the inside handle is operated manually to open the door or when the ratchet 6 is released at an ordinary speed, a biasing force of the second spring 75 that acts on the second lever 73 is greater than a biasing force of the second spring 74 that acts on the first lever 71, so that the second lever 73 does not rotate from the initial position to the blocking position clockwise against the biasing force of the second spring 75. Even if a force greater than the biasing force of the second spring 75 acts on the second lever 73 owing to any reason during a releasing motion of the first lever 71, an upper edge of the second lever 73 comes in contact with an arc-shaped portion 2*c* at lower part of the stationary stopper 2*b* of the engagement-mechanism housing 2 from below in FIG. 8(*a*)(*b*). Hence, the second lever 73 is prevented from moving to the blocking position, thereby making sure of the releasing motion of the first lever 71 based on manual door-opening motion with the outside handle or the inside handle.

<When the door panel is deformed by a crash>

In FIG. 6(*a*)(*b*), the door panel is deformed by the crash, and the deformation of the door panel acts on the outside lever 9 directly or indirectly to rotate the outside lever 9 in a releasing direction. The pawl 6*a* is likely to disengage from the full-latch engagement portion 5*b* of the latch 5.

In view of the foregoing situation, even if the door panel is deformed, the ratchet 6 and the opening lever 8 are prevented from releasing, and the pawl 6*a* of the ratchet 6 can completely be prevented from disengaging from the full-latch engagement portion 5*b* of the latch 5.

In order to prevent the ratchet 6 and the opening lever 8 from releasing, there are a first case at a higher speed and a second case at a greatly higher speed than a releasing speed of the ratchet 6 and the opening lever 8 when the door is opened manually.

The first case will be described.

When a force for rotating the outside lever 9 in a releasing direction acts by deforming the door, the ratchet 6 and the opening lever 8 rotate at a high speed in a releasing direction from the engagement position in FIG. 6(*a*).

When the ratchet 6 and the opening lever 8 rotate at the high speed in the releasing direction, the contact portion 8*b* of the opening lever 8 immediately comes in contact with the contacted portion 73*a* of the second lever 73 in FIG. 9(*a*)(*b*). A force for rotating the first lever 71 in the releasing direction is transmitted, and simultaneously the second lever 73 rotates clockwise around the second shaft 72 against the biasing force of the second spring 75 to the blocking position.

When the second lever 73 rotates to the blocking position, the front edge 73*b* of the second lever 73 becomes contactable with the stationary stopper 2*b* of the engagement-mechanism housing 2, and the first lever 71 is prevented from rotating in the releasing direction immediately. Thus, the ratchet 6 and the opening lever 8 slightly rotate in the releasing direction, but are prevented from rotating further in the releasing direction, so that the pawl 6*a* of the ratchet 6 does not disengage from the full-latch engagement portion 5*b* of the latch 5.

Then, the second case will be described.

Owing to deformation of the door panel, a force for rotating the outside lever 9 in the releasing direction acts and rotates the ratchet 6 and the opening lever 8 at a higher speed in the releasing direction than the first case from the engagement position in FIG. 6(*a*).

In this case, because the speed that acts on the ratchet 6 and the opening lever 8 is very high, the ratchet 6 and the opening lever 8 rotate in the releasing direction by a distance corresponding to the gap L as above. The rotation makes the contact portion 8*b* of the opening lever 8 contact the contacted portion 73*a* of the second lever 73, which rotates to the blocking position immediately, but the first lever 71 does not rotate from the initial position.

When the ratchet 6 and the opening lever 8 rotate in the releasing direction by a distance corresponding to the gap L, the second lever 73 rotates to the blocking position in FIG. 10(*a*)(*b*), and the contact portion 6*b* of the ratchet 6 comes in contact with the preventing portion 71*a* of the first lever 71 that rests at the initial position.

Because the line F of action that acts on the preventing portion 71*a* of the first lever 71 is opposite to the releasing direction of the first lever 71, the first lever 71 does not rotate from the initial position in the releasing direction. Thus, the ratchet 6 is prevented from rotating in the releasing direction, and the pawl 6*a* of the ratchet 6 can be prevented from disengaging from the full-latch engagement portion 5*b* of the latch 5.

The foregoing relates to one embodiment of the present invention, and the following changes and variations may be made without departing from claims as below:

(a) The ratchet 6 and the opening lever 8 are integrally formed.

(b) The first lever 71 and the second lever 73 are changed in shape.

What is claimed is:

1. A vehicle door latch device comprising:

a base member;

a latch pivotally mounted to the base member to enable the latch to engage with a striker when a door is closed;

a ratchet pivotally mounted to the base member and engaging with the latch to hold the door closed, a releasing action of a door handle disengaging the ratchet from the latch to enable the door to open;

a stationary stopper mounted on the base member;

a first lever pivotally mounted to the base member on a first shaft to rotate from an initial position in a releasing direction for allowing disengagement of the ratchet from the latch;

a first spring that exerts a biasing force on the first lever toward the initial position;

a second lever supported on a second shaft to rotate at a certain angle, the second lever being rotatable between an initial position that does not prevent the first lever from rotating in the releasing direction at said position in the releasing direction and at said initial position, the second lever does not contact the stationary stopper, and a blocking position that prevents the first lever from rotating in the releasing direction and at said blocking position, the second lever can contact the stationary stopper; and a second spring that biases the second lever toward the initial position with a biasing force greater than the biasing force of the first spring, wherein, when the ratchet is manually rotated by a door handle to open the door, the second lever, when in the initial position, revolves around the first shaft with rotation of the first lever in the releasing direction, and when the ratchet is rotated to open the door by deforming of a door panel at a crash, the second lever rotates from the initial position to the blocking position against the biasing force of the second spring such that a contacting part of the second lever prevents rotation of the first lever in the releasing direction, wherein the first lever has a preventing portion that contacts a part of the ratchet to prevent the ratchet from disengaging from the latch when the second lever rotates to the blocking position.

2. The vehicle door latch device of claim 1 wherein the first spring engages with the base member at one end and with the first lever at another end.

3. The vehicle door latch device of claim 1 wherein the second spring engages with the first lever at one end and with the second lever at another end.

* * * * *